US010455990B2

(12) United States Patent
Dozois

(10) Patent No.: US 10,455,990 B2
(45) Date of Patent: Oct. 29, 2019

(54) TRACKLESS, FRAMELESS BI-FOLD DOORS FOR USE WITH A SHOWER OR BATHTUB

(71) Applicant: Gus's Kitchen & Bath Limited, Peterborough, Ontario (CN)

(72) Inventor: Gaston Yvon Dozois, Ontario (CN)

(73) Assignee: Gus's Kitchen & Bath Limited, Peterborough, Ontario (CA)

( * ) Notice: Subject to any disclaimer, the term of this patent is extended or adjusted under 35 U.S.C. 154(b) by 0 days.

(21) Appl. No.: 14/996,361

(22) Filed: Jan. 15, 2016

(65) Prior Publication Data

US 2017/0202403 A1 Jul. 20, 2017

(51) Int. Cl.

| | |
|---|---|
| ***A47K 3/36*** | (2006.01) |
| ***E06B 3/48*** | (2006.01) |
| ***E06B 3/02*** | (2006.01) |
| ***E05D 3/02*** | (2006.01) |

(52) U.S. Cl.

CPC ..... *A47K 3/362* (2013.01); *E05D 3/02* (2013.01); *E06B 3/02* (2013.01); *E06B 3/481* (2013.01)

(58) Field of Classification Search

CPC .... A47K 3/362; A47K 3/36; A47K 2003/367; E06B 3/02

USPC ..... 4/607

See application file for complete search history.

(56) References Cited

U.S. PATENT DOCUMENTS

| | | | | |
|---|---|---|---|---|
| 5,097,543 | A * | 3/1992 | Oille | A47K 3/36 160/210 |
| 5,123,129 | A * | 6/1992 | Lyons | A47K 3/36 16/390 |
| 5,845,344 | A * | 12/1998 | Lenighan | A47K 3/362 4/557 |
| 5,893,181 | A * | 4/1999 | Moncaster | A47K 3/362 160/211 |
| 5,911,519 | A * | 6/1999 | Eutebach | A47K 3/362 4/607 |
| 6,056,376 | A * | 5/2000 | Yenglin | E05D 15/58 312/138.1 |
| 6,363,547 | B1 * | 4/2002 | Perry | A47K 3/30 4/612 |
| 7,346,939 | B2 * | 3/2008 | Perry | A47K 3/34 4/557 |
| 8,826,472 | B2 * | 9/2014 | Hoernig | E03C 1/24 4/607 |
| 2008/0093520 | A1 * | 4/2008 | Chang | E05D 5/0246 248/226.11 |
| 2008/0211359 | A1 * | 9/2008 | Borgstrom | A47F 3/043 312/116 |
| 2013/0212798 | A1 * | 8/2013 | Schindler | A47K 3/30 4/514 |
| 2015/0059081 | A1 * | 3/2015 | Anakhin | A47K 3/30 4/614 |

* cited by examiner

*Primary Examiner* — J C Jacyna
(74) *Attorney, Agent, or Firm* — James Creighton Wray

(57) ABSTRACT

There are described fully trackless, frameless bi-fold doors for use with conventional bathtubs, showers, or walk-in bathtubs.

1 Claim, 12 Drawing Sheets

TRACKLESS, FRAMELESS BI-FOLD DOORS FOR USE WITH A SHOWER OR BATHTUB

FIELD OF THE INVENTION

This invention relates to showers, conventional bathtubs, or walk-in bathtubs. In particular, this invention relates to folding doors for use with showers, conventional bathtubs, or walk-in bathtubs.

BACKGROUND OF THE INVENTION

Shower doors are often used with showers, conventional bathtubs, or walk-in bathtubs to allow privacy and to prevent water splashing over the bathroom floor. In many cases, rigid panels are used which slide in place by means of top and bottom rails having guiding channels therein. Alternatively, hinged panels are opened and closed, with the top and bottom of the panels maintained within these same channels.

The disadvantages of using shower doors with tracks include:

- Access to the bathing area is limited.
- Installing the tracks of the shower doors is difficult.
- The track often appears unattractive.
- Cleaning the tracks is difficult and debris tends to accumulate.
- The accumulation of debris worsens the performance of the door.
- Bathing children and other dependent individuals can be a challenge due to the presence of the top and bottom tracks.
- Wheelchair access is limited by the bottom tracks in a shower.

It would be desirable to have a hinged door design that that can open either to the side, inside or outside of the walk-in tub. In addition, it would be advantageous for the hinged door design not to require a top rail which can interfere with entering or exiting the bathtub or shower, or with bathing by a carer. Further, it would be advantageous for the hinged door design not to require a bottom rail which would be prone to the accumulation of dirt, mold and the like, and also interferes with access.

SUMMARY OF THE INVENTION

According to one embodiment of the invention there is provided fully trackless, frameless bi-fold doors for use with a conventional bathtub, shower, or walk-in bathtub. The doors open fully to allow access to a full shower or conventional bathtub by the user.

DETAILED DESCRIPTION

Referring to the Figures, there are shown trackless, frameless, bi-fold doors 2 for use with a conventional bathtub 20, shower, or walk-in bathtub 22.

Figure 1:
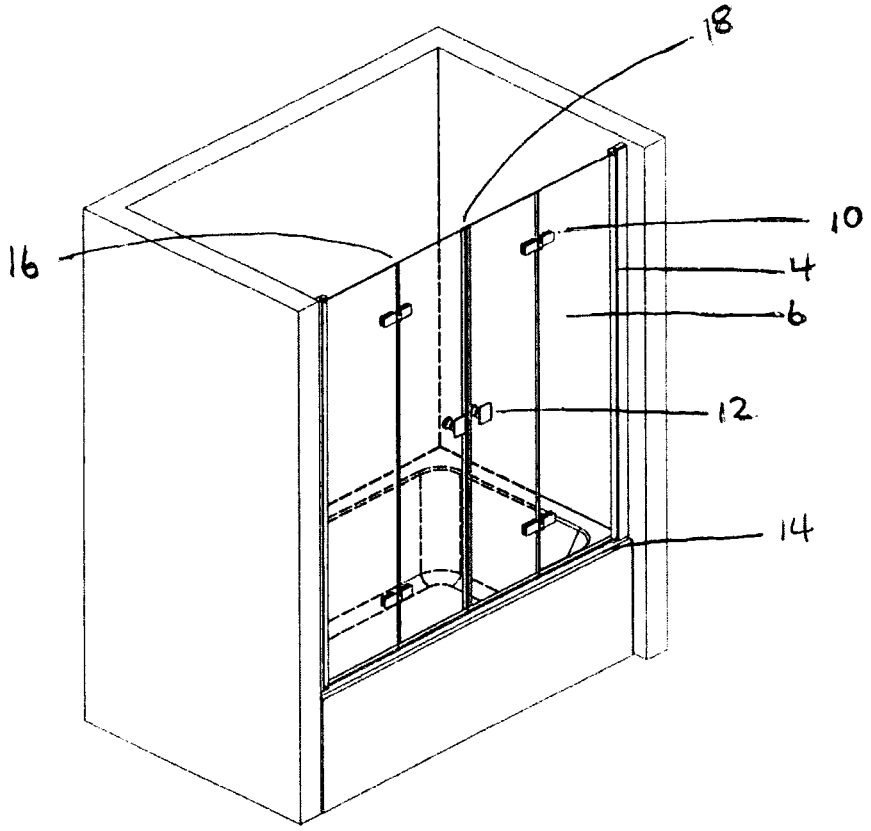
FIG. 1 is a view of the first embodiment of the trackless, frameless bi-fold doors for a conventional bathtub, with or without shower, in closed position.

Referring to FIG. 1, there is shown a view of the trackless, frameless bi-fold doors 2 for a shower or conventional bathtub 20 in closed position. The hinged bi-fold doors 2 has a magnetic seal strip 18 in the middle to keep the two doors 2 secure. Preferably combined width of both doors 2 is 56" wide×60" high with a Mazak (chrome) hinge, pivot and handle. The glass is preferably 6 mm clear and the gasket is a magnet+PVC (Polyvinyl chloride) (clear). Each door is preferably a swing door type and has an adjustment of 15 mm on each side. Preferably the bottom aluminum rail is 90 mm in height.

Figure 2:
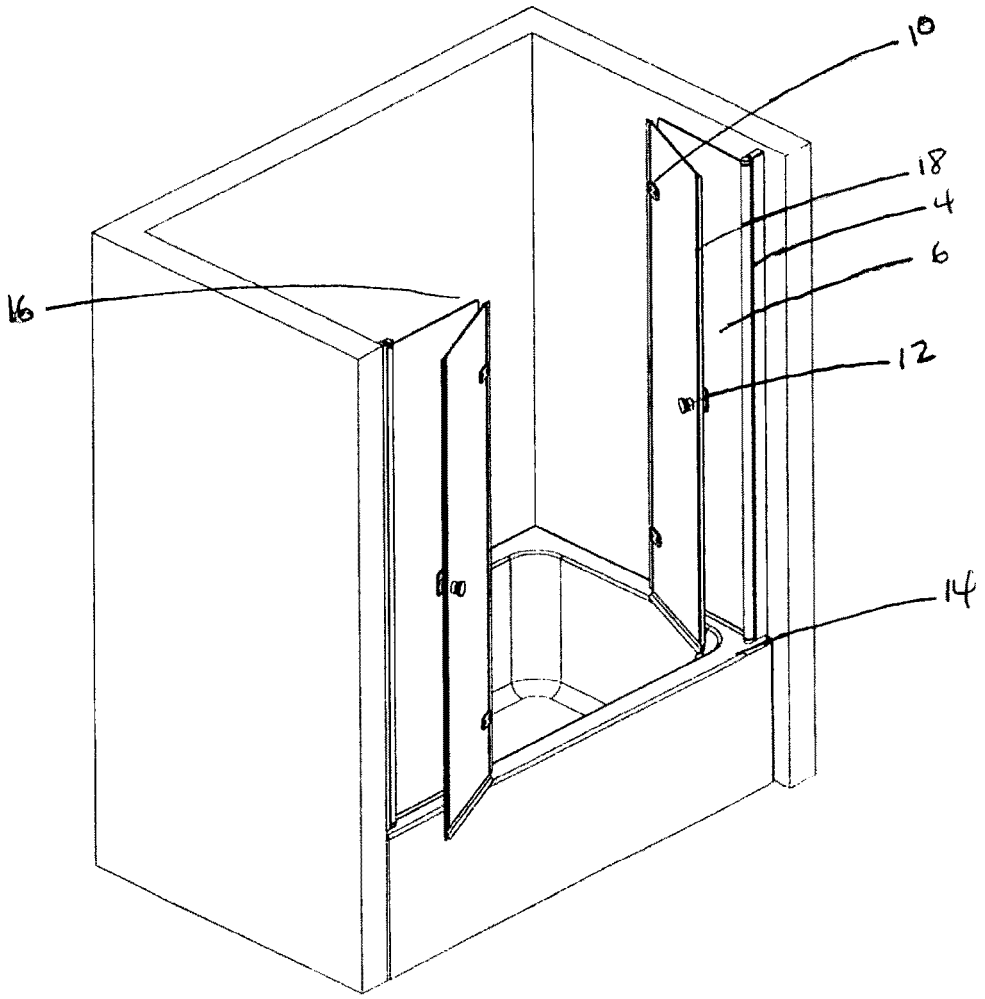
FIG. 2 is a view of the trackless, frameless bi-fold doors for a conventional bathtub, with or without shower, of FIG. 1 in open position.

Referring to FIG. 2, the trackless, frameless bi-fold doors 2 are shown in open position whereby the doors 2 open inwards into a conventional bathtub 20 if needed and also open outwards out of the conventional bathtub 20, thus allowing a full 100% bathing access.

Figure 3A:
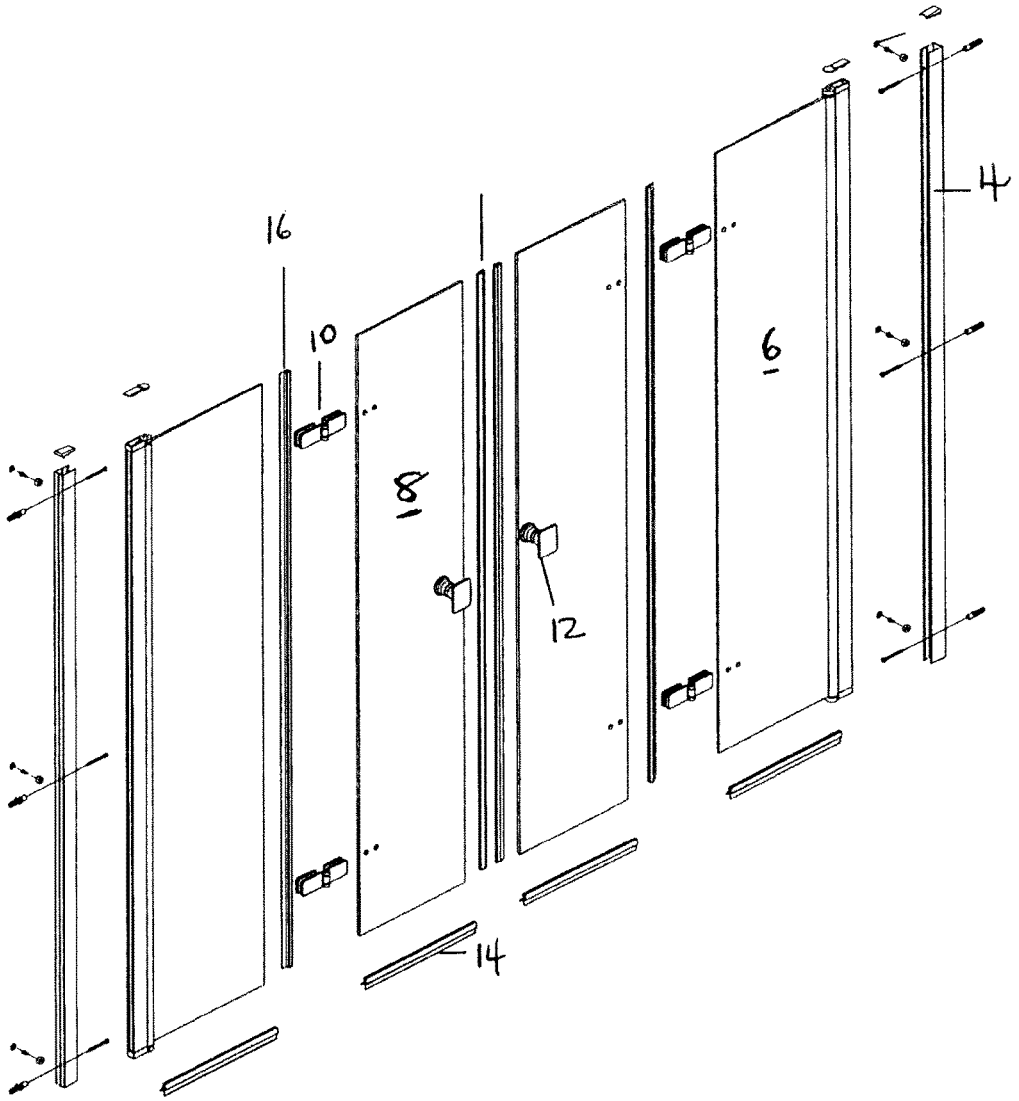
FIG. 3A is an exploded view of the contents for the first embodiment of the trackless, frameless bi-fold doors shown in FIG. 1.

Referring to FIG. 3A there is shown an exploded view of the contents for the first embodiment of the trackless, frameless bi-fold doors 2 shown in FIG. 1. The contents include two wall jambs 4, two fixed panels 6, two door panels 8, two handles 12, four bottom seal strips 14, two vertical seal strips 16, and two magnetic seal strips 18. Additional hardware is included for assembly.

Figure 3B:
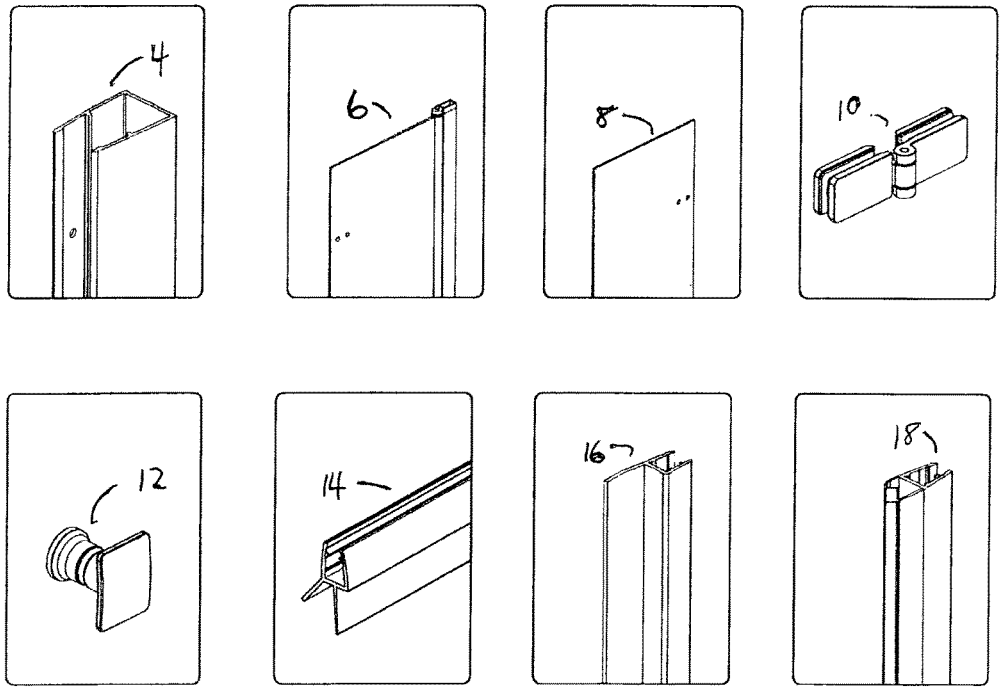
FIG. 3B is detailed views of the contents for the first embodiment of the trackless, frameless bi-fold doors shown in FIG. 1.

Referring to FIG. 3B there is shown detailed views of the contents for the first embodiment of the trackless, frameless bi-fold doors shown in FIG. 1.

Figure 4:
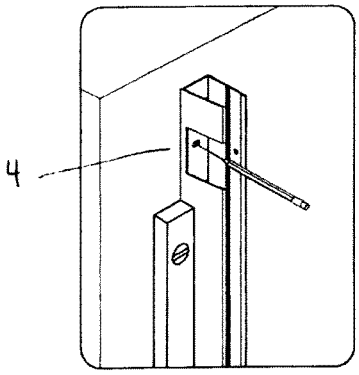
FIG. 4(*a*) to (*e*) are detailed views showing the wall jamb installation for the trackless, frameless bi-fold doors shown in FIG. 1.
Figure 4:
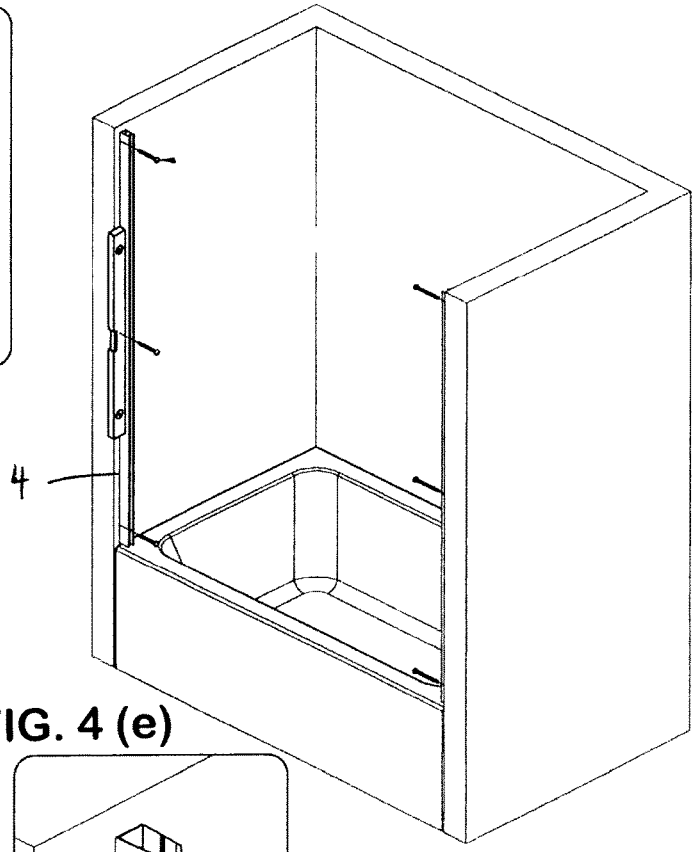
Figure 4:
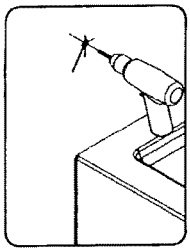
Figure 4:
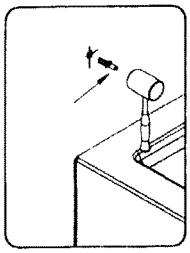
Figure 4:
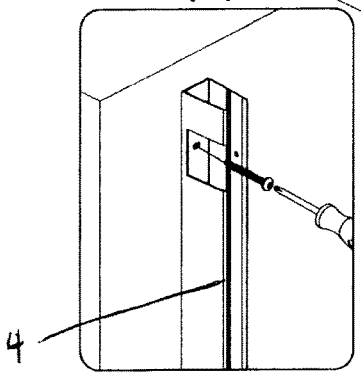

Referring to FIG. 4 (*a*) to (*e*) are detailed views showing the wall jamb 4 installation for the trackless, frameless bi-fold doors 2 shown in FIG. 1. The conventional bathtub 20 is checked to make sure that it is level. Each wall jamb 4 is place on the side walls of the conventional bathtub 20, kept level, and then holes are marked. The wall jamb 4 is temporarily removed while the holes are drilled with an electric drill having a 5/16" bit. Wall anchors are hammered into place with a rubber hammer or mallet. The wall jamb 4 is then secured with screws by a screwdriver.

Figure 5:
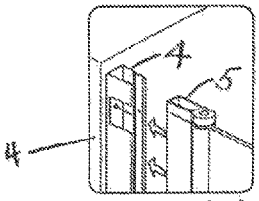
FIG. 5(*a*) to (*g*) are detailed views showing the fixed panel installation for the trackless, frameless bi-fold doors shown in FIG. 1.
Figure 5:
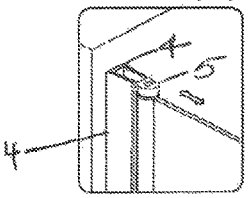
Figure 5:
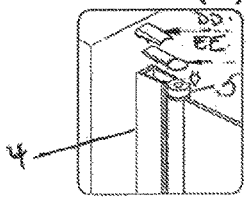
Figure 5:
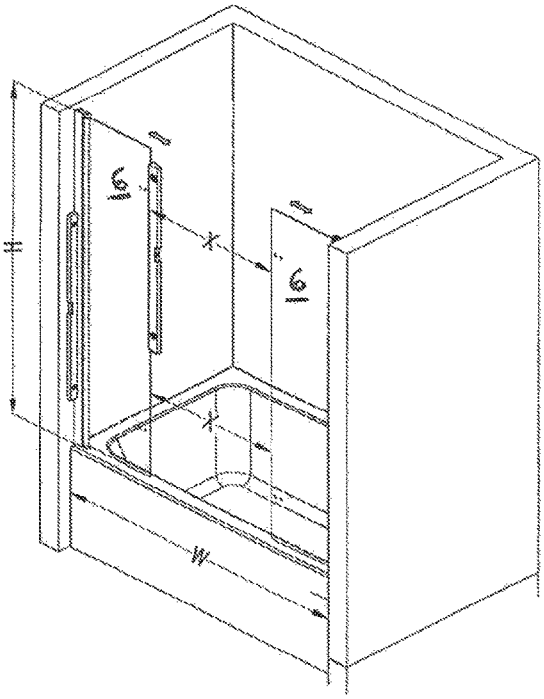
Figure 5:
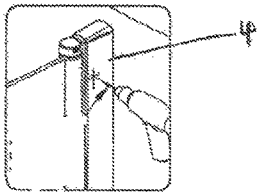
Figure 5:
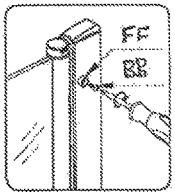
Figure 5:
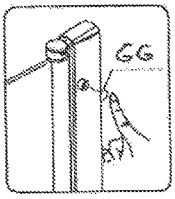

Referring to FIG. 5(*a*) to (*g*) are detailed views showing the fixed panel 6 installation for the trackless, frameless bi-fold doors 2 shown in FIG. 1. In FIG. 5(*b*) the fixed panel 6 is installed to a wall jamb 4. In FIG. 5(c) the two fixed panels 6 are adjusted and the width (X) is measured to ensure that the width is correct. In FIG. 5(d) the cap EE is installed on the aluminum and the cap DD is installed. In FIG. 5(e) the holes are drilled with a ⅛" drill bit. In FIG. 5(f) the fitting FF is secured with screws BB by a screw driver. In FIG. 5(g) the cap GG is pushed by hand.

Figure 8:
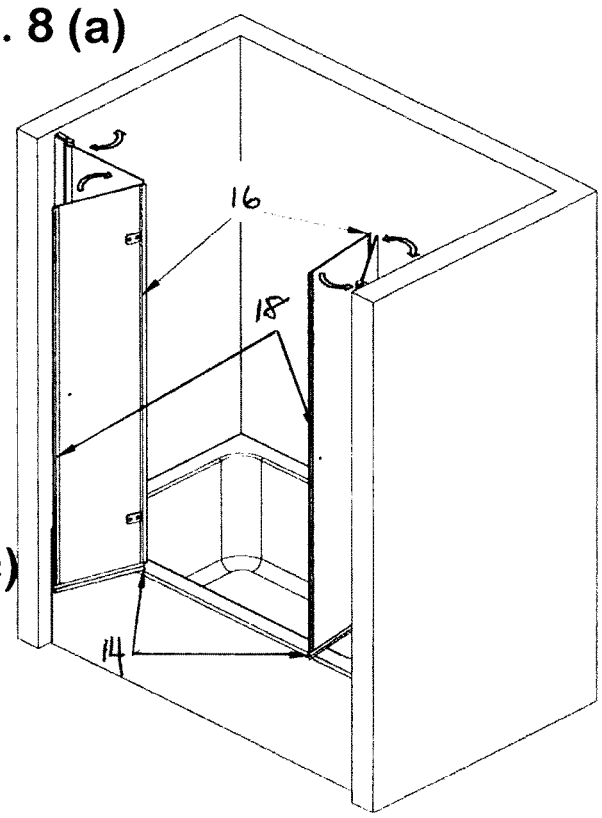
FIG. 8(*a*) to (*g*) are detailed views showing the seal strip installation for the trackless, frameless bi-fold doors shown in FIG. 1.
Figure 8:
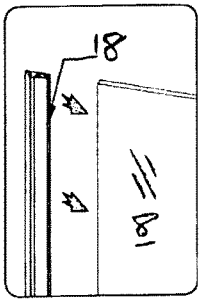
Figure 8:
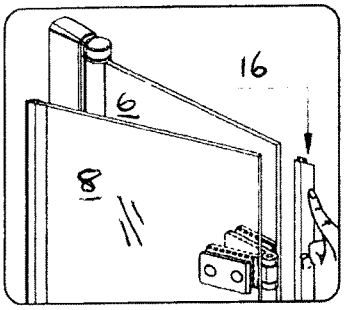
Figure 8:
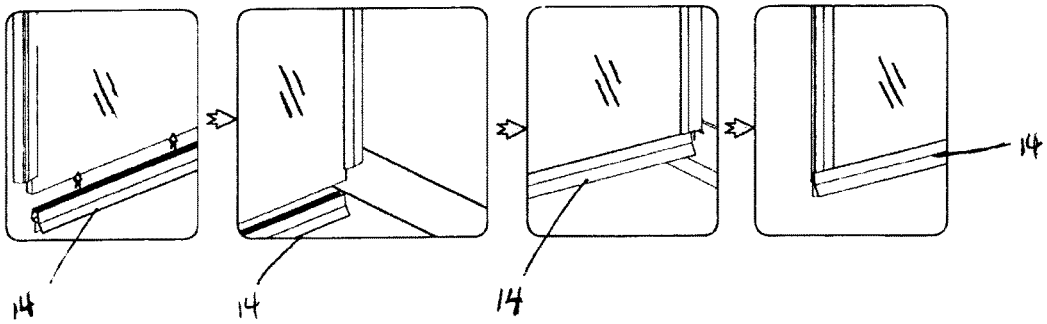
Figure 11:
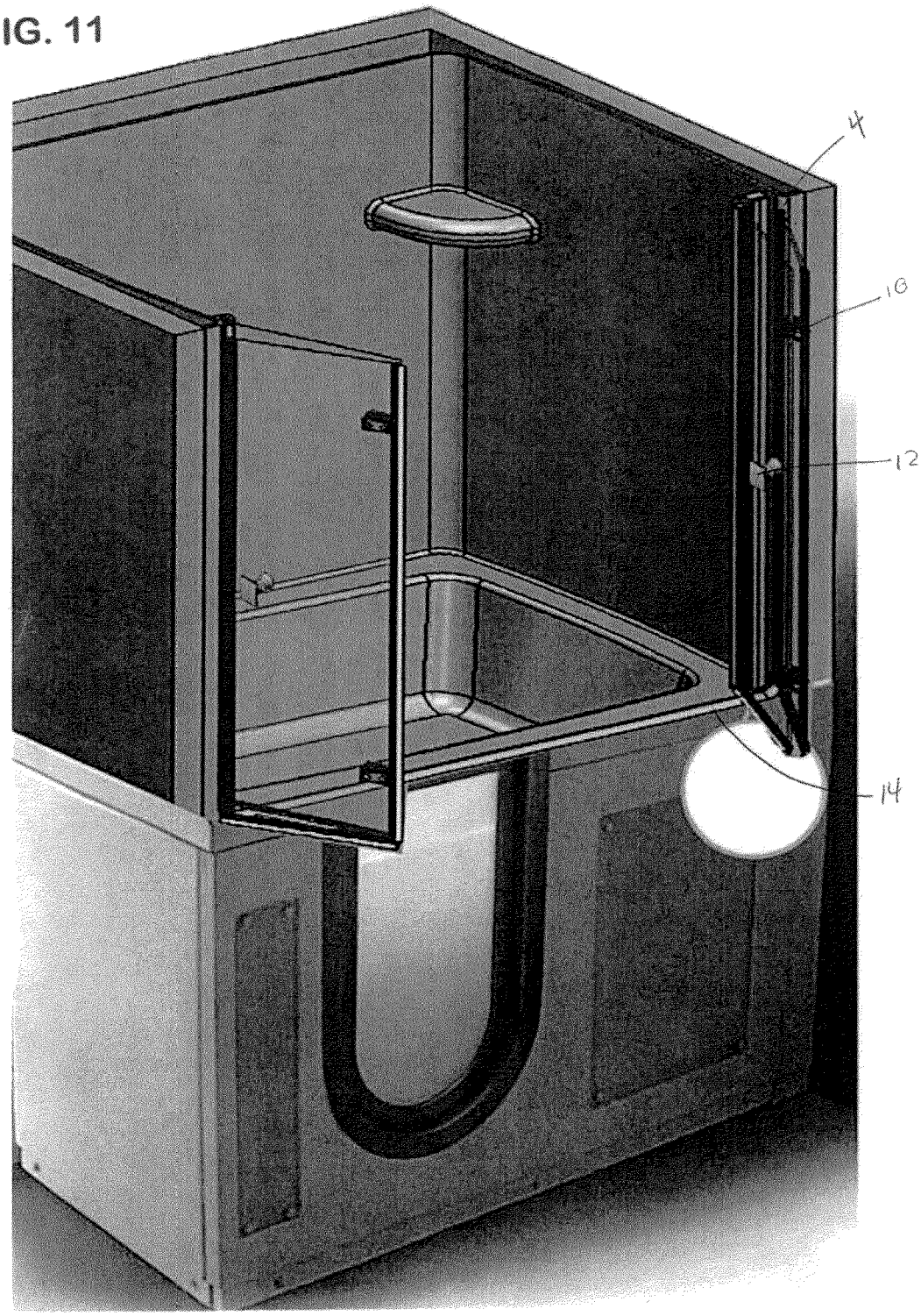
FIG. 11 is a perspective view of the walk-in bathtub, with or without a shower, of FIG. 4 in open position.

As shown in FIGS. 5(b) and 5(c) of the current application, outer fixed door panels 6 include vertical hinge assemblies 5 that are fixed in wall jams 4. Door panels 6 swing inward as shown in FIG. 8(a) and outward as shown in FIG. 11.

Figure 6:
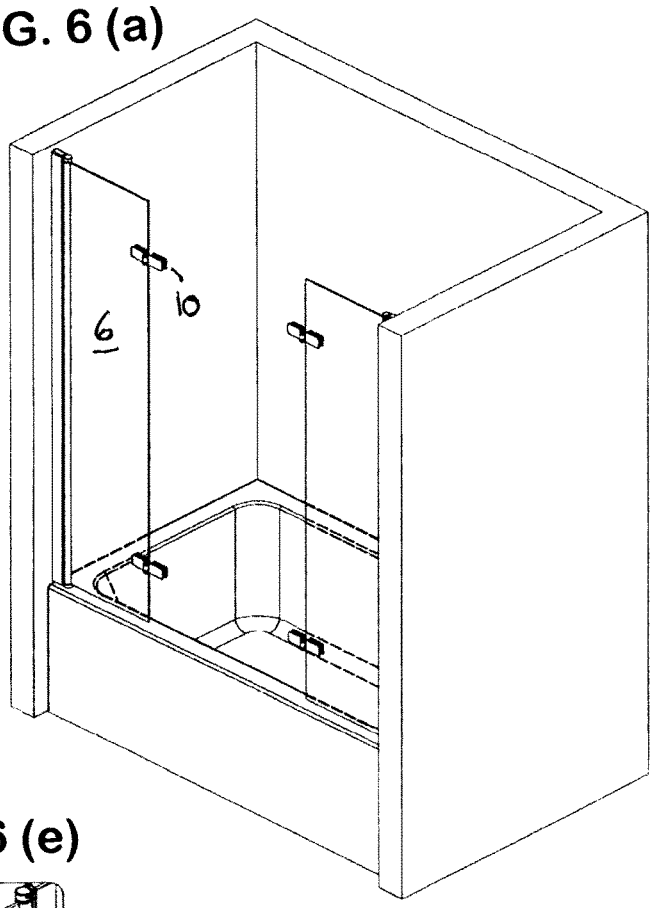
FIG. 6(*a*) to (*e*) are detailed views showing the hinge installation for the trackless, frameless bi-fold doors shown in FIG. 1.
Figure 6:
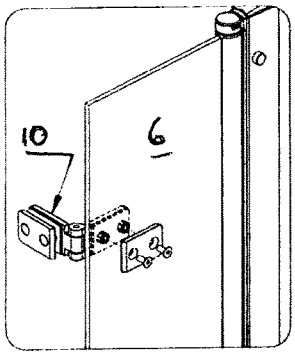
Figure 6:
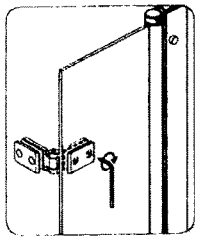
Figure 6:
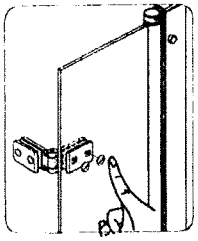
Figure 6:
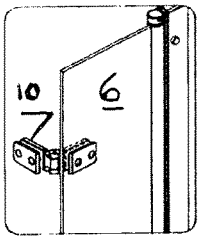

Referring to FIG. 6(a) to (e) are detailed views showing the hinge 10 installation for the trackless, frameless bi-fold doors 2 shown in FIG. 1. In FIG. 6(b) the hinge 10 is unscrewed with an Allen key, then the hinges 10 are installed to the fixed panel 6. In FIG. 6(c) the hinges 10 are tightened clockwise with an Allen key. In FIG. 6(d) the hinge cap is pushed by hand. In FIG. 6(e) the hinges 10 and the fixed panel 6 are shown correctly installed.

Figure 7:
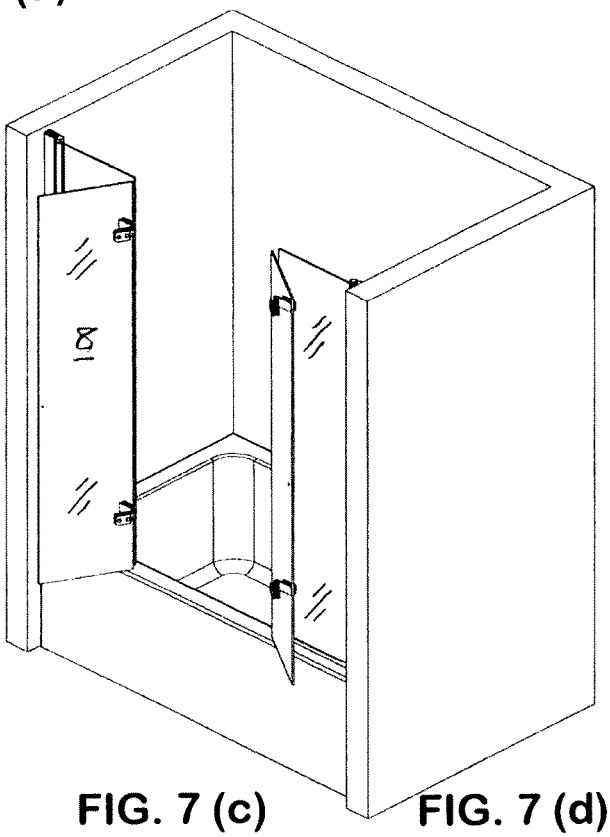
FIG. 7(*a*) to (*e*) are detailed views showing the door panel installation for the trackless, frameless bi-fold doors shown in FIG. 1.
Figure 7:
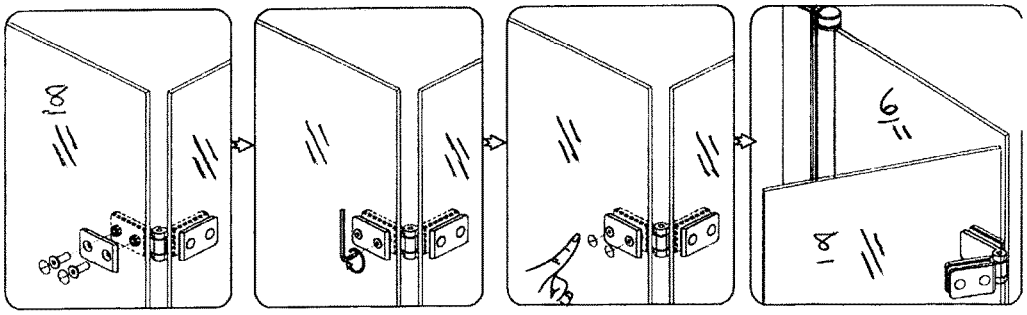

Referring to FIG. 7(a) to (e) are detailed views showing the door panel 8 installation for the trackless, frameless bi-fold doors 2 shown in FIG. 1. In FIG. 7(b) the hinges 10 are unscrewed with an Allen key, then the hinges 10 are installed to the door panel 8. In FIG. 7(c) the hinges 10 are tightened with an Allen key. In FIG. 7(d) the hinge cap is pushed by hand. In FIG. 7(e) the hinges 10 and the door panel 8 are shown correctly installed.

Referring to FIG. 8(a) to (g) are detailed views showing the seal strip installation for the trackless, frameless bi-fold doors 2 shown in FIG. 1. In FIG. 8(b) the magnetic seal strip 18 is installed by hand to the door panel 8. In FIG. 8(c) the vertical seal strip 16 is installed by hand to the door panel 8. In FIGS. 8(d) and (e) the bottom seal strip 14 is installed by hand to the door panel 8 and the fixed panel 6. In FIGS. 8(f) and (g) the bottom seal strip 14 is shown installed correctly.

Figure 9:
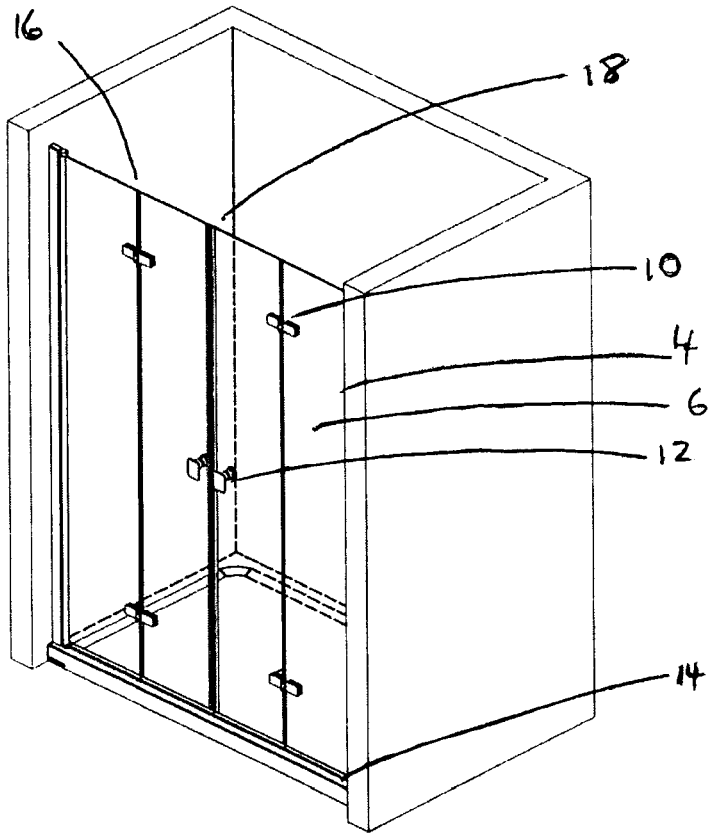
FIG. 9 is a perspective view of a second embodiment of the trackless, frameless bi-fold doors for a shower.
Figure 10:
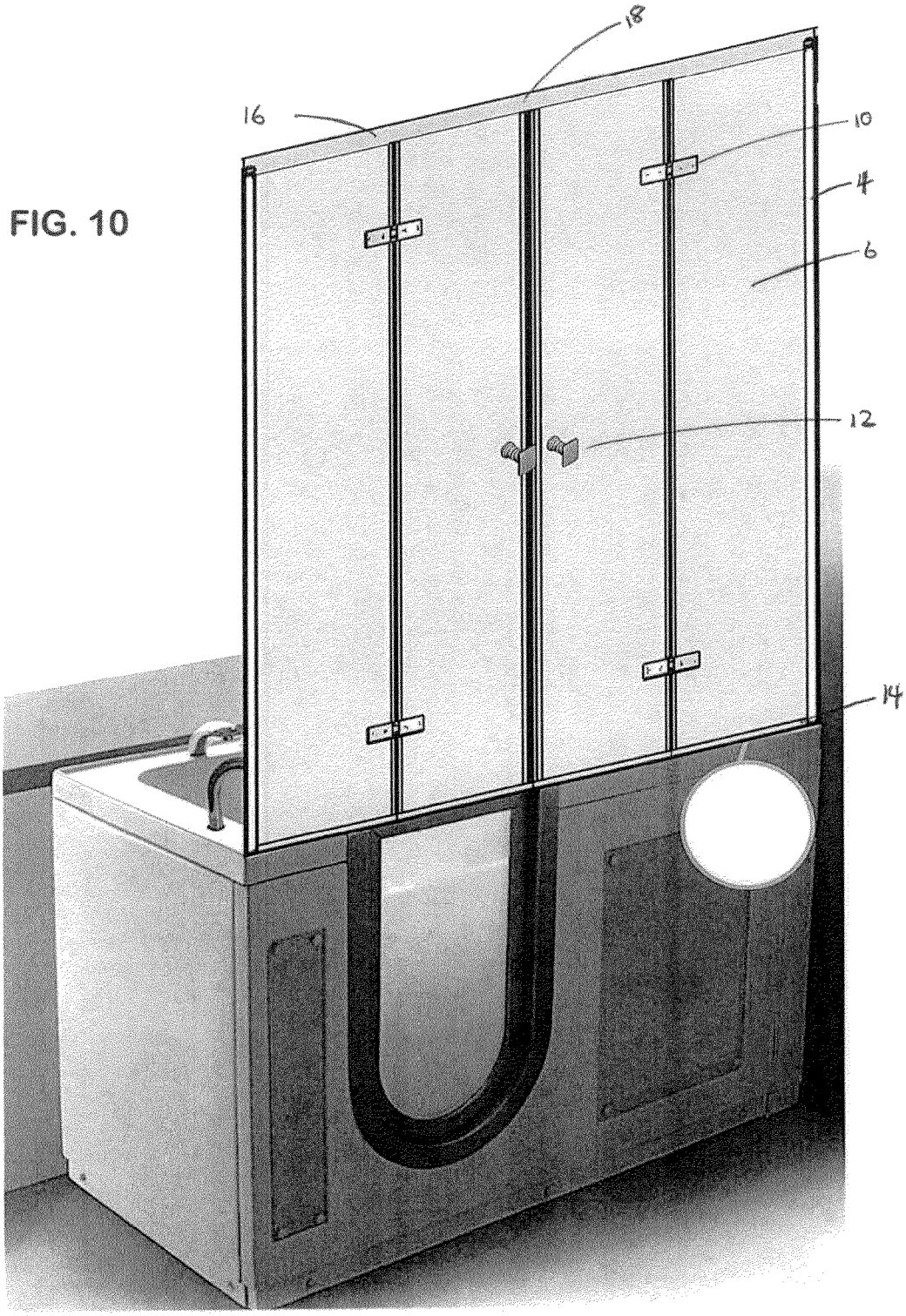
FIG. 10 is a perspective view of a second embodiment of the trackless, frameless bi-fold doors for a walk-in bathtub, with or without a shower, in closed position.

Referring to FIG. 9 there is shown a perspective view of a second embodiment of the trackless, frameless bi-fold doors for a shower;

Referring to FIG. 10 there is shown a view of an embodiment of the trackless, frameless bi-fold doors 2 for a walk-in bathtub 22 in closed position.

Referring to FIG. 11 there is shown a view of the walk-in bathtub 22 of FIG. 4 without the doors 2.

It will be seen that there is no track at the bottom or top of the doors 2. These are the first fully trackless shower doors 2. The two way trackless, frameless, bi-fold shower or conventional bathtub doors 2 open fully to allow access to a full shower or conventional bathtub 20 by the user.

The frameless bi-fold doors 2 allow for easy cleaning of both the doors 2 and the conventional bathtub 20 or shower. The doors 2 are coated with an easily cleaned coating allowing easier glass maintenance Adjustable wall jams 4 (side rails) are provided for the wall assembly which allows the doors 2 to be adjusted, as required, to enable the placement of a magnetic seal strip 18 to close the doors 2.

Hinges are made of extra strong durable materials to allow the weight of the doors 2 to operate with ease.

(i) Conventional Bathtub

When used with a conventional bathtub 20, as shown in FIGS. 1 to 8, the absence of a bottom track allows parents and carers to bathe babies and other dependent individuals in a conventional bathtub 20 without the discomfort of leaning over the track.

The bi-fold doors 2 can open inwards into a conventional bathtub 20 if needed and also open outwards out of the conventional bathtub 20, thus allowing a full 100% bathing access.

(ii) Shower

When used with a shower, as shown in FIG. 9 the user or carer has the ability to drive a wheelchair into a shower because there is no bottom track. Similarly, as there is also no upper track, a carer is able to walk easily into the shower with a patient without hitting their head on the upper track.

Hinges 10 bi-fold in both directions allowing the doors 2 to open in both directions into a shower or out of a shower for full user optimization.

(iii) Walk-In Bathtub

When used with a walk-in bathtub 22, as shown in FIGS. 10 and 11, the trackless, frameless bi-fold doors 2 allows full access to persons helping an individual in a walk-in bathtub 22 with a door. The bi-fold doors 2 creates a full showering seal on the entire walk-in bathtub 22 including the movable door area.

The trackless, frameless bi-folding fully open doors 2 creates an entire seal throughout the entire walk-in bathtub 22 allowing the person using the walk-in bathtub 22 to enter into the walk-in bathtub 22 by the doors unobstructed by a door frame.

The bi-fold doors 2 fully open to allow persons using the door in a walk in bathtub 22 to have a person help them unobstructed when bathing or showering in a walk in bathtub 22 with a door.

The scope of the claims should not be limited by the preferred embodiments set forth in the examples, but should be given the broadest interpretation consistent with the description as a whole.

LIST OF REFERENCES

2 Trackless, frameless bi-fold doors
4 Wall jamb
6 Fixed panel
8 Door panel
10 Hinge
12 Handle
14 Bottom seal strip
16 Vertical seal strip
18 Magnetic seal strip
20 Conventional bathtub
22 Walk-in bathtub

The invention claimed is:

1. Apparatus comprising two trackless and frameless bi-foldable glass panel doors, each bi-foldable glass panel door having an inner panel and an outer panel, wherein the outer panels are mounted on vertical hinges adapted to be attached to first and second walls at ends of a bath enclosure and are configured for folding the bi-foldable glass panel doors and swinging the folded frameless bi-foldable glass panel doors outward from or inward into the bath enclosure, wherein the two frameless bi-foldable glass panel doors are mounted without a top track that would interfere with access to the bath enclosure and without a bottom track that would be prone to accumulation of dirt, further comprising first and second wall jambs attached to walls at outer edges of a bath enclosure, wherein the vertical hinges are hinged fittings attached to outer edges of the outer panels of the two frameless bi-foldable glass panel doors, the hinged fittings being connected to the wall jambs, and further comprising two bi-fold hinges connected between the outer panel and the inner panel of each bi-foldable glass panel door, a handle attached near an inner end of each inner panel, and a magnetic steel strip connected to an inner edge of each inner panel of the frameless bi-foldable glass panel doors.

* * * * *